US009523466B2

(12) United States Patent
Nishimoto et al.

(10) Patent No.: US 9,523,466 B2
(45) Date of Patent: Dec. 20, 2016

(54) PRESSURE VESSEL

(71) Applicant: Mitsubishi Rayon Co., Ltd., Chiyoda-ku (JP)

(72) Inventors: Tadahiro Nishimoto, Toyohashi (JP); Yoshio Hoya, Tokyo (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 14/414,768

(22) PCT Filed: Jul. 18, 2013

(86) PCT No.: PCT/JP2013/069495

§ 371 (c)(1),
(2) Date: Jan. 14, 2015

(87) PCT Pub. No.: WO2014/014049

PCT Pub. Date: Jan. 23, 2014

(65) Prior Publication Data

US 2015/0167893 A1 Jun. 18, 2015

(30) Foreign Application Priority Data

Jul. 18, 2012 (JP) ..... 2012-159638

(51) Int. Cl.
*B65D 6/40* (2006.01)
*F17C 1/16* (2006.01)
*F17C 1/06* (2006.01)

(52) U.S. Cl.
CPC . *F17C 1/16* (2013.01); *F17C 1/06* (2013.01); *F17C 2201/0109* (2013.01);
(Continued)

(58) Field of Classification Search
CPC ..... F17C 1/16; F17C 1/06; F17C 2203/0675; F17C 2223/035; F17C 2203/066; F17C 2223/036; F17C 2205/0305; F17C 2203/0604; B65D 11/08
(Continued)

(56) References Cited

U.S. PATENT DOCUMENTS 5,819,978 A 10/1998 Hlebovy
5,979,692 A * 11/1999 West ..... F17C 1/16 220/586

(Continued)

FOREIGN PATENT DOCUMENTS

JP 08-303693 A 11/1996
JP 10-231998 A 9/1998

(Continued)

OTHER PUBLICATIONS

International Search Report dated Aug. 27, 2013 for International Application No. PCT/JP2013/069495.

(Continued)

*Primary Examiner* — Fenn Mathew
*Assistant Examiner* — Don M Anderson
(74) *Attorney, Agent, or Firm* — Morgan, Lewis & Bockius LLP

(57) ABSTRACT

A pressure vessel comprises a liner formed by blow-molding; an FRP layer covers the outer surface of the liner; and a stock comprising a stock main body, formed from metal with a cylindrical section passing through the liner and FRP layer and a circular metal flange section projecting outward from one end of the cylindrical section in the radial direction of the cylindrical section, and a molded piece, formed of a synthetic resin, covers at least the outer circumferential surface of the cylindrical section and all the metal flange section of the stock main body, has a circular resin flange section projecting outward from the edge of the metal flange section that faces outward in the radial direction, and
(Continued)

adheres to the inner surface of the liner. The resin flange section comprises an upper surface, an outer circumferential edge surface and a lower surface.

8 Claims, 6 Drawing Sheets

(52) U.S. Cl.
CPC *F17C 2201/056* (2013.01); *F17C 2203/0604* (2013.01); *F17C 2203/066* (2013.01); *F17C 2203/0619* (2013.01); *F17C 2203/0663* (2013.01); *F17C 2203/0675* (2013.01); *F17C 2205/0305* (2013.01); *F17C 2209/2118* (2013.01); *F17C 2209/2127* (2013.01); *F17C 2223/0123* (2013.01); *F17C 2223/0153* (2013.01); *F17C 2223/035* (2013.01); *F17C 2223/036* (2013.01); *F17C 2270/01* (2013.01)

(58) Field of Classification Search
USPC ..... 220/601, 582, 586, 587, 588, 589, 592,220/581
See application file for complete search history.

(56) References Cited

U.S. PATENT DOCUMENTS

2010/0025411 A1* 2/2010 Otsubo ..... F17C 1/14 220/581
2010/0255234 A1 10/2010 Koetke
2011/0101002 A1 5/2011 Strack
2012/0291878 A1* 11/2012 Pisot ..... F17C 1/06 137/315.01
2014/0239001 A1* 8/2014 Ulekleiv ..... F17C 1/06 220/589

FOREIGN PATENT DOCUMENTS

JP 10-332082 A 12/1998
JP 11-082887 A 3/1999
JP 2007-263290 A 10/2007
JP 2008-164112 A 7/2008
JP 2008-164114 A 7/2008
JP 2008-256151 A 10/2008
JP 2012-189106 A 10/2012
WO 2011/145300 A1 11/2011
WO 2011/152732 A1 12/2011
WO WO2011/152732 * 12/2011 ..... F17C 1/16

OTHER PUBLICATIONS

Japanese Office Action issued in Japanese Patent Application No. 2014-219592 on Jul. 7, 2015.

European Search Report issued in European Patent Application No. 13819854.4 on Sep. 29, 2015.

* cited by examiner

PRESSURE VESSEL

TECHNICAL FIELD

The present invention relates to a pressure vessel for containing gas, liquefied gas or the like, in particular, to a pressure vessel having a liner body formed by blow-molding and an FRP layer that covers an outer surface of the liner body. More particularly, the present invention relates to a pressure vessel in which a flange section of a stock overlaps an inner surface of the liner body.

This application claims priority to and the benefit of Japanese Patent Application No. 2012-159638 filed on Jul. 18, 2012, the disclosure of which is incorporated herein by reference.

BACKGROUND ART

As a pressure vessel made of a synthetic resin for containing various gases, liquefied gases or the like, various configurations having a liner body and a FRP layer covering the outer surface of the liner body have been suggested.

The pressure vessel is provided with a stock that forms a gas entrance. In many cases, the stock is made of metal.

Patent Document 1 discloses a pressure vessel having a configuration in which a liner body is formed by blow-molding, and a flange section included in the stock overlaps the inner surface of the liner body. FIGS. 10 and 11 are a cross-sectional view and a diagram illustrating a manufacturing process of the pressure vessel of Patent Document 1, respectively.

As in FIG. 10, the pressure vessel 5 disclosed in Patent Document 1 has a vessel main body section constituted of a liner body 1 formed by blow-molding, an FRP layer 2 covering an outer surface of the liner body 1, and a stock 3 provided in the vessel main body section. The stock 3 has a cylindrical section 3b having a gas entrance 3a and a flange section 3c that is formed to spread from a vessel inner end (a lower end in FIG. 10) side of the cylindrical section 3b along an inner surface of the liner body 1. An adhesive resin layer 4 is interposed between the stock 3 and the liner body 1. In addition, Patent Document 1 discloses that the adhesive resin layer 4 is formed of polyethylene-based thermoplastic resin to enhance the adhesive strength between the liner body 1 and the stock 3.

Patent Document 1 discloses the method described below, as a method of manufacturing the pressure vessel 5. First, as illustrated in FIG. 11, the stock 3 is supported by a support rod 6 and disposed between a pair of liner body molding dies 7, and a parison 9 in a cylindrical shape is suspended from the die 8 of a blow-molding machine around an outer circumferential surface of the stock 3. Next, the pair of dies 7 is clamped. The parison 9 in soft state is pressed against the outer surface of the stock 3 by the die clamping. The adhesive resin 4 provided on the outer surface of the stock 3 melts by heat of the parison 9, and the parison 9 and the stock 3 are bonded to each other. By blowing air into the parison 9 to inflate the parison 9 and press it against the inner surface of the dies 7, the liner body 1 is molded. After demolding, the outer surface of the liner body 1 is covered with fiber yarns, bundles or mats, such as carbon fiber yarns or bundles, and glass fiber yarns or bundles in which thermosetting resin such as epoxy resin and unsaturated polyester resin is impregnated, which is cured to form the FRP (CFRP, GFRP or the like) layer 2.

Since the pressure vessel 5 disclosed in Patent Document 1 is easily manufactured by blowing the interior of the parison 9 after disposing the stock 3 between the pair of dies 7 and clamping the dies. In this respect, it is possible to reduce the manufacturing cost, compared to the known synthetic resin pressure vessels manufactured by disposing a stock (or a cap) on the outer surface of the liner body and welding the cap on the liner body by spin-welding.

CITATION LIST

Patent Document

Patent Document 1: JP 2008-164114 A

DISCLOSURE OF THE INVENTION

Problem to be Solved by the Invention

In the pressure vessel 5 disclosed in Patent Document 1, the stock 3 is formed of a metal or resin. When the stock 3 is formed of a metal as a whole, the weight of the stock 3 becomes large. In addition, since adhesive force between the metallic stock and the resin liner body is insufficient, there is a risk of degradation of the gas sealing properties of the interface between them.

Meanwhile, when the entire stock 3 is formed of resin, strength and rigidity may become insufficient.

In particular, when the entire stock 3 is formed of resin, the rigidity of the flange section 3c is lowered. For that reason, when the dies 7 are clamped to press the parison 9 against the outer surface of the stock 3, the flange section 3c may bend inward to the vessel, the parison 9 may be insufficiently pressed against the flange section 3c, the adhesive strength between the liner body 1 and the stock flange section 3c may become insufficient, and the gas sealing properties of the interface between them may be lowered.

In order to solve the above-described problems in prior art, an object of the present invention is to provide a pressure vessel that has a blow-molded liner body and an FRP layer covering the outer surface of the liner body, in which the flange section of the stock overlaps the inner surface of the liner body, adhesive strength between the liner body and the stock flange section is high, and the gas sealing properties in the interface between them are excellent.

Means for Solving Problem

The pressure vessel according to an aspect of the present invention includes a liner body formed by blow-molding; an FRP layer that covers an outer surface of the liner body; and a stock having a stock main body formed of metal, which has a cylindrical section that passes through the liner body and the FRP layer and an annular metal flange section that projects outward from one end of the cylindrical section in the radial direction of the cylindrical section, and a molded piece formed of a synthetic resin that covers at least an outer circumferential surface of the cylindrical section and the entire metal flange section of the stock main body, has an annular resin flange section projecting outward from the metal flange section in the radial direction, and adheres to the inner surface of the liner body, wherein the resin flange section has an upper surface, an outer circumferential end surface and a lower surface, the outer circumferential end surface is provided on an end portion of the resin flange section that faces outward in the radial direction, and the liner body continuously covers the upper surface and a part of the outer circumferential end surface.

In addition, in the present invention, the upper surface of the resin flange section is the surface of the resin flange section that faces toward the outside of the vessel, and the lower surface of the resin flange section is the surface of the resin flange section that faces toward the inside of the vessel.

The intersecting angle θ between the outer circumferential end surface and the upper surface may be an acute angle.

The intersecting angle θ may be 20° to 60°, and the height of the outer circumferential end surface may be 1 to 30 mm.

The molded piece may continuously cover from the lower surface of the metal flange section to the inner circumferential surface of the cylindrical section.

The metal flange section may be provided with a through hole through which the upper surface and the lower surface of the metal flange section communicate with each other, and the molded piece may fill the through hole.

The molded piece is preferably formed by injection molding.

Effect of the Invention

In the pressure vessel according to an aspect of the present invention, the stock has a stock main body formed of metal which has a cylindrical section that passes through the liner body and the FRP layer and an annular metal flange section that projects outward from one end of the cylindrical section in the radial direction of the cylindrical section, and a molded piece made of a synthetic resin that covers at least the outer circumferential surface of the cylindrical section and the entire metal flange section of the stock main body. Thus, the stock is lighter than stocks which are formed only of metal, and has strength and rigidity higher than stocks which are formed only of resin.

For that reason, since the stock can be strongly pressed against the parison during blow-molding, both members may firmly adhere, and it is possible to increase the gas sealing properties between the stock and the liner body (parison).

Furthermore, in the pressure vessel according to an aspect of the present invention, since the surface adhering to the inner surface of the liner body is formed of the molded piece, adhesive strength between the resin liner body and the molded piece is high. Thus, the gas sealing properties between the stock and the liner body increase.

In the pressure vessel according to an aspect of the present invention, the intersecting angle θ between the outer circumferential end surface of the resin flange and the upper surface is an acute angle. For that reason, when pressing the stock against the parison, the parison bulges at the peripheral edge portion of the stock, and the bulged portion covers a part of the outer circumferential end surface. Thus, the gas sealing properties between the stock and the liner body (parison) increase.

In addition, in the pressure vessel according to an aspect of the present invention, since the outer circumferential portion of the flange section (resin flange section) of the stock has an outer circumferential end surface, strength and rigidity of the outer circumferential end portion of the stock are high. Thus, when pressing the parison against the stock, the outer circumferential end portion of the stock is prevented from bending in a direction inward of the vessel. Therefore, the adhesive strength between the parison and the stock increases, and the gas sealing properties between the stock and the liner body (parison) increase.

In the pressure vessel according to an aspect of the present invention, the molded piece covers at least the outer circumferential surface of the cylindrical section and the overall metal flange section of the stock main body. In this case, since the metal flange section is present in the flange section of the stock, the strength and rigidity of the flange section of the stock increase.

In the pressure vessel according to an aspect of the present invention, the molded piece further continuously covers from the lower surface of the metal flange section to the inner circumferential surface of the cylindrical section. This makes it possible to improve the integrity between the molded piece and the metal stock main body.

In addition, in the present invention, the lower surface of the metal flange section is the surface of the metal flange section that faces toward the inside of the vessel.

In the pressure vessel according to an aspect of the present invention, the stock main body has a cylindrical section which passes through the liner body and the FRP layer, and an annular metal flange section that protrudes outward from one end of the cylindrical section in the radial direction of the cylindrical section. Furthermore, the metal flange section is provided with a through hole through which the outer surface and the inner surface of the metal flange section communicate with each other, and the molded piece fills the through hole. Thus, the molded piece on the outer surface and the molded piece on the inner surface of the metal flange section are connected to each other, which makes it possible to improve the integrity between the metal stock main body and the molded piece.

In the pressure vessel according to an aspect of the present invention, by forming the molded piece by injection molding, it is possible to mold the molded piece easily and at low cost.

MODE(S) FOR CARRYING OUT THE INVENTION

Hereinafter, embodiments of the present invention will be described with reference to the drawings.

[First Embodiment]

FIGS. 1 to 4 illustrate a pressure vessel according to first to fourth embodiments of the present invention and a manufacturing method thereof.

Figure 2:
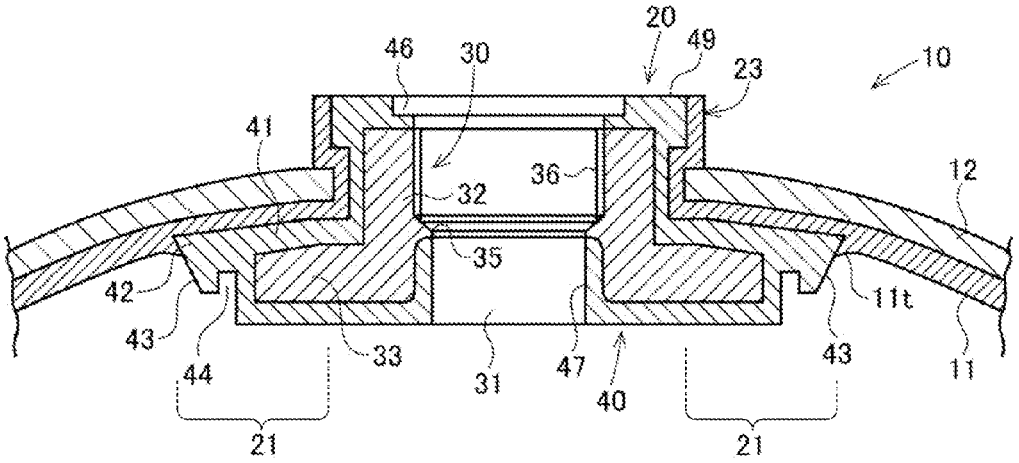
FIG. 2 is a cross-sectional view illustrating a structure near the stock of the pressure vessel according to the first embodiment of the present invention.

A pressure vessel 10 illustrated in FIG. 2 has a blow-molded liner body 11, an FRP layer 12 that covers the outer surface of the liner body 11, and a stock 20 having a flange section 21 that adheres to the inner surface of the liner body 11.

Figure 1:
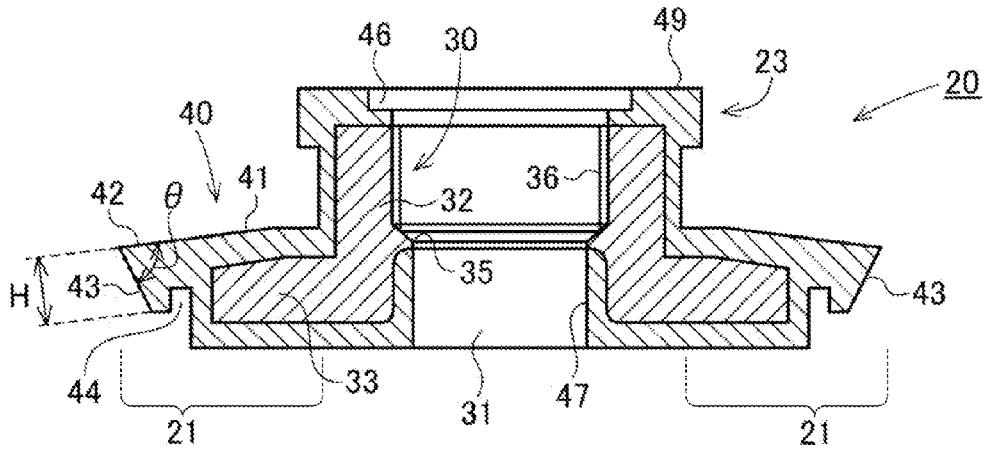
FIG. 1 is a cross-sectional view illustrating a structure of a stock used in a pressure vessel according to a first embodiment of the present invention.

As illustrated in FIG. 1, the stock 20 penetrates the liner body 11 and the FRP layer 12, has a stock main body 30 made of metal having a gas entrance 31, and has a molded piece 40 made of synthetic resin that covers an outer circumference of the stock main body 30. In addition, an external shape of a top end portion (outer end portion of the vessel) 23 of the stock 20 is a hexagonal shape to be able to be hooked with a tool such as a wrench or the like.

The stock main body 30 has a cylindrical section 32 that forms the gas entrance 31 and passes through the interior and exterior of the pressure vessel 10 in a cylindrical axial direction, and an annular metal flange section 33 that protrudes outward in radial directions of the cylindrical section 32 from the end (lower end) of the cylindrical section 32 in the vessel.

The molded piece 40 continuously covers the outer circumferential surface of the cylindrical section 32, the upper surface (the surface facing the liner body) of the metal flange section 33, the leading end of the metal flange section 33, and the lower surface (the surface of the opposite side of the upper surface) of the metal flange section 33. In this embodiment, the molded piece 40 covers the upper end surface (the end surface of the vessel outside) of the cylindrical section 32 of the stock main body 30, and has an inner circumferential surface section 47 that continuously covers from the lower surface of the metal flange section 33 to the inner circumferential surface of the gas entrance 31 via the edge portion of the gas entrance 31.

Furthermore, on the inner circumferential surface of the stock main body 30 an elongated convexity 35 inward in the radial direction of the stock main body 30 is annularly disposed at an intermediate portion in the cylinder axial direction. The inner circumferential surface section 47 of the molded piece 40 covers the inner circumferential surface of the gas entrance 31 from the elongated convexity 35 toward the vessel inside (the lower end of the cylindrical section 32). A female screw 36 is formed on the inner circumferential surface of the gas entrance 31 from the elongated convexity 35 toward the vessel outside, and a gas supplying and extracting valve or the like can be attached thereto by screwing.

The molded piece 40 is equipped with an annular resin flange section 42 that projects outward from the metal flange section 33 in the radial direction of the metal flange section 33. The resin flange section 42 is formed of the upper surface, the outer circumferential end surface 43 and the lower surface, and has a predetermined thickness. The upper surface of the resin flange section 42 is formed to be the same surface as the upper surface of the top surface section 41 that covers the upper surface of the metal flange section 33. The outer circumferential end surface 43 is provided at the end portion of the resin flange section 42 that faces outward in the radial direction. It is preferable that the height H of the outer circumferential end surface 43 be 1 to 30 mm, and particularly 3 to 20 mm. Here, the height H of the outer circumferential end surface 43 refers to a distance between the upper surface of the resin flange section 42 (the top surface of the top surface section 41) and the lower end of the outer circumferential end surface 43 (the tangent of the end portions of the outer circumferential end surface 43 and the lower surface of the resin flange section 42).

An intersecting angle θ between the outer circumferential end surface 43 and the upper surface of the resin flange section 42 (the top surface of the top surface section 41) is preferably 10° to 85°, more preferably 20 to 60°, and particularly preferably 20° to 45°.

In order to prevent sink marks during molding of the resin flange section 42, a groove 44 is annularly provided on the lower surface of the resin flange section 42.

In addition, the pressure vessel of the present invention is not limited to a configuration in which the groove is provided on the lower surface of the resin flange as in this embodiment, and the groove need not be provided on the lower surface of the resin flange.

The molded piece 40 is continuously formed from the lower end surface of the stock main body 30 to the molded piece inner circumferential surface section 47 via the corner edge of the gas entrance 31.

In this embodiment, as described above the molded piece 40 covers from the outer circumferential surface to the upper end surface of the cylindrical section 32 of the stock main body 30. On the inner circumferential corner edge of the top section 49 forming the upper end surface portion of the molded piece, a step section 46 for mounting a seal ring such as an O-ring is provided.

The molded piece 40 is preferably formed by injection-molding. In this case, the stock 20 is manufactured by molding the molded piece 40 by insert-molding following disposing the stock main body 30 within the injection-molding dies.

Figure 4:
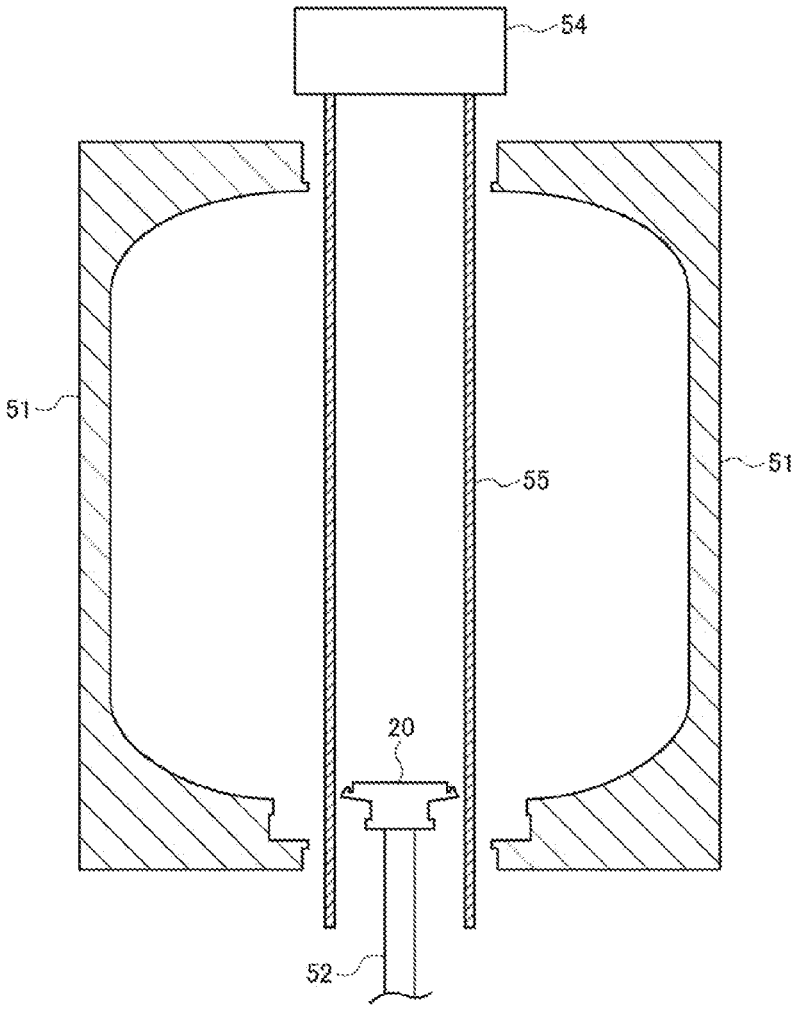
FIG. 4 is a cross-sectional view illustrating a method of manufacturing the pressure vessel according to the first embodiment of the present invention.

A pressure vessel 10 using a stock 20 is manufactured as follows. As illustrated in FIG. 4, the stock 20 is disposed between a pair of blow-molding dies 51 so as to be supported by a support rod 52, a cylindrical parison 55 is extruded from a circular die 54, and the stock 20 is surrounded by the parison 55.

Thereafter, the dies 51 and 51 are clamped to press the parison 55 against the outer surface of the stock 20. Next, the liner body 11 is blow-molded by blowing gas such as air into the parison 55 to inflate the parison 55 and to press the parison 55 against the inner surface of the dies 51 and 51. After cooling, the liner body 11 with the stock 20 is demolded, and thereafter, the FRP layer is formed on the outer circumferential surface of the liner body 11 by a filament winding method, a tape winding method, or the like.

In addition, during blow-molding, it is preferable to preheat the stock 20 to a room temperature or higher.

In addition, in the case that the parison 55 is pressed against the outer surface of the stock 20 by clamping the blow dies 51 and 51 during the blow-molding of the liner body 11 and the metal flange section 33 exists on the base end side of the flange section 21 of the stock 20, the strength and rigidity of the pressure vessel 10 increase. Since the resin flange section 42 protruding outward from the metal flange section 33 has a large thickness H, the strength and rigidity are high. For that reason, when pressing the parison 55 against the flange section 21, the resin flange section 42 is not bent inward to the vessel, the parison 55 is tightly pressed against the entire top surface of the flange section 21, and both the parison 55 and the flange section 21 cohere with each other.

Figure 3:
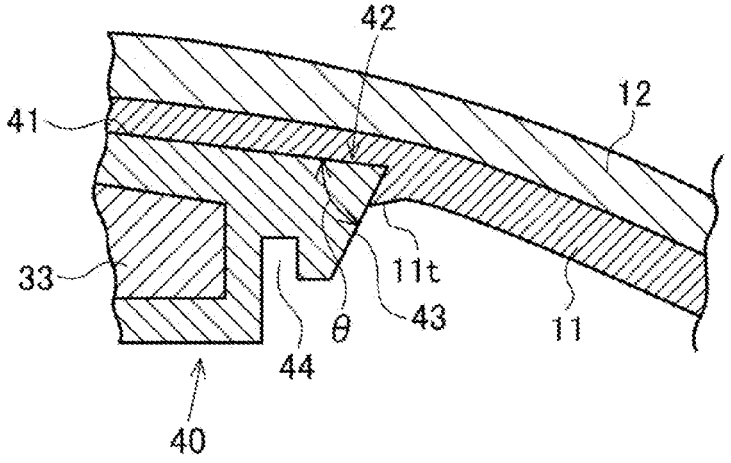
FIG. 3 is an enlarged view near a leading end of a stock flange section illustrated in FIG. 2.

When the parison 55 is pressed against the flange section 21, the flange section 21 bites into the parison 55, a part of the liner body 11 formed from the parison 55 bulges along the outer circumferential end surface 43 of the resin flange section 42 as illustrated in FIG. 3, and the bulged portion 11*t* covers a part of the outer circumferential end surface 43. Thus, the penetration of gas from the pressure vessel 10 to the interface between the resin flange section 42 of the molded piece 40 and the liner body 11 is prevented, and thus, the gas sealing properties of the interface are improved.

Furthermore, since the intersecting angle θ between the upper surface of the resin flange section 42 and the outer circumferential end surface 43 thereof is an acute angle, a structure is achieved in which the acute angle section of the leading edge of the flange section 42 is interposed between the solidified bulged portion 11*t* and the liner body 11 formed on the upper side of the resin flange section 42. Thus, the strength of the joint between the resin flange section 42 and the liner body 11 is enhanced.

In the pressure vessel 10 of this embodiment, the stock 20 is lighter than a cap formed of only metal, the strength and rigidity thereof including the resin flange section 42 are high as described above, and the liner body 11 and the molded piece 40 firmly coheres with each other. Therefore, the strength of the joint between the liner body 11 and the molded piece 40 is high, and the gas sealing properties of the interface between the liner body 11 and the molded piece 40 are very good. Furthermore, since the liner body 11 has the bulged portion 11*t* that covers a part of the outer circumferential end surface 43, the interface between the liner body 11 and the resin flange section 42 is covered by the bulged portion 11*t*. Therefore, the pressure vessel 10 has excellent gas sealing properties at the interface.

In the pressure vessel 10, the molded piece 40 has an inner circumferential surface section 47 that continuously covers from the lower surface of the stock main body 30 (metal flange section 33) to the inner circumferential surface of the gas entrance 31 (cylindrical section 32). In this case, integrity between the molded piece 40 and the stock main body 30 is high, and the gas sealing properties of the interface between the molded piece 40 and the stock main body 30 are excellent.

Stocks used for pressure vessels according to other embodiments of the present invention are illustrated in FIGS. 5 to 9.

[Second Embodiment]

Figure 5:
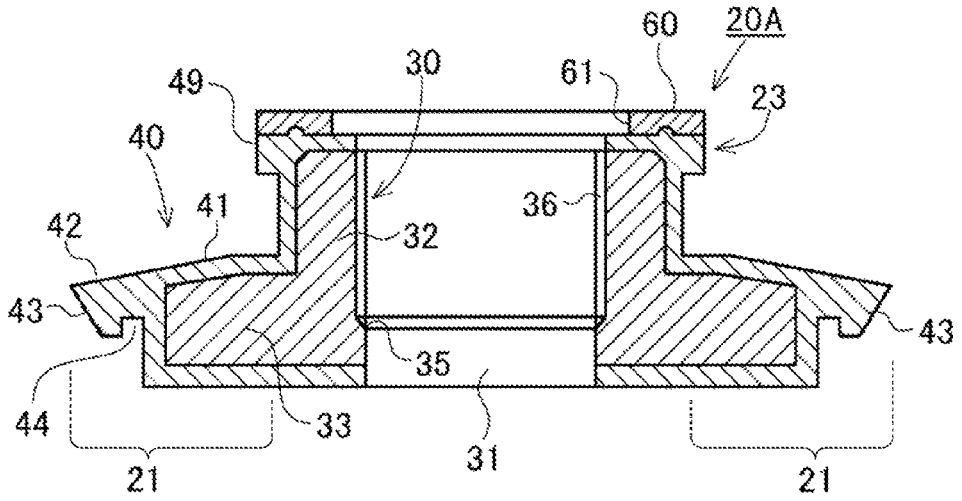
FIG. 5 is a cross-sectional view illustrating a structure of a stock used for a pressure vessel according to a second embodiment of the present invention.

FIG. 5 illustrates a stock 20A used in a pressure vessel according to the second embodiment of the present invention.

The stock 20A illustrated in FIG. 5 is equipped with a metal ring 60 that is formed of a brass or the like and provided on the upper side of the molded piece top section 49 that covers the upper end surface of the stock main body 30. In addition, in this embodiment, the top surface of the molded piece top section 49 is a plane, and a seal ring installation section 61 for an O-ring or the like is formed on the inner side of the inner circumferential surface of the metal ring 60 and on the top surface of the molded piece top section 49.

Furthermore, in this embodiment, the elongated convexity 35 of the inner circumferential surface of the gas entrance 31 illustrated in the above-described first embodiment is not provided. The molded piece 40 is not provided with the inner circumferential surface section 47 that covers the inner circumferential surface of the gas entrance 31. Other configurations are the same as those of the stock 20, and the same reference numerals designate the same parts.

In addition, the configuration not provided with the inner circumferential surface section 47 as in this embodiment is also appropriately applicable to other embodiments. Furthermore, a configuration including the inner circumferential surface section 47 illustrated in the above-described first embodiment is also appropriately applicable to this embodiment.

In addition, the metal ring 60 may be integrated with the molded piece 40 by insert-molding and may be bonded to the molded piece top section 49 with an adhesive.

[Third Embodiment]

Figure 6:
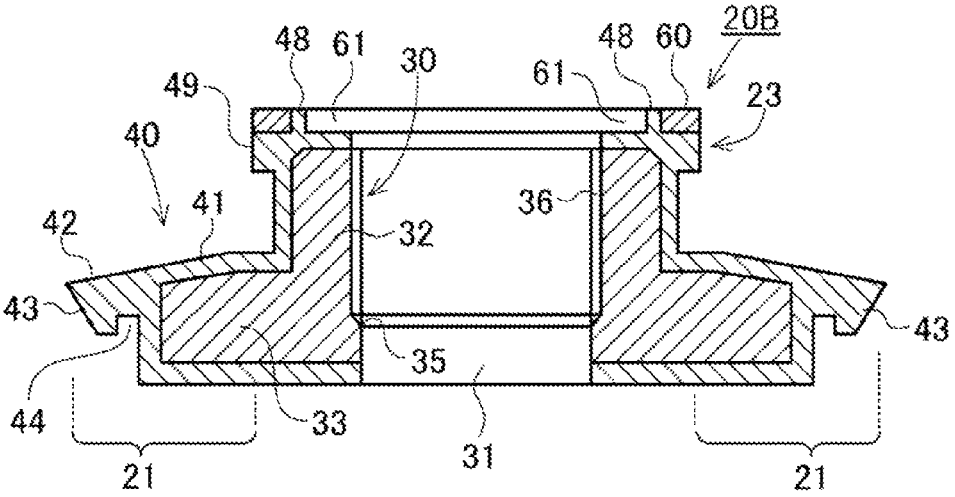
FIG. 6 is a cross-sectional view illustrating a structure of a stock used for a pressure vessel according to a third embodiment of the present invention.

FIG. 6 illustrates a stock 20B used in a pressure vessel according to the third embodiment of the present invention.

The stock 20B illustrated in FIG. 6 has an elongated convexity 48 that is annularly provided on the top surface of the molded piece top section 49 configured to cover the upper end surface of the stock main body 30, and a metal ring 60 that is provided on the outer circumferential side of the elongated convexity 48. Furthermore, a seal ring installation section 61 is provided on the inner circumferential side of the elongated convexity 48. Other configurations are the same as those of the second embodiment, and the same reference numerals designate the same parts.

[Fourth Embodiment]

Figure 7:
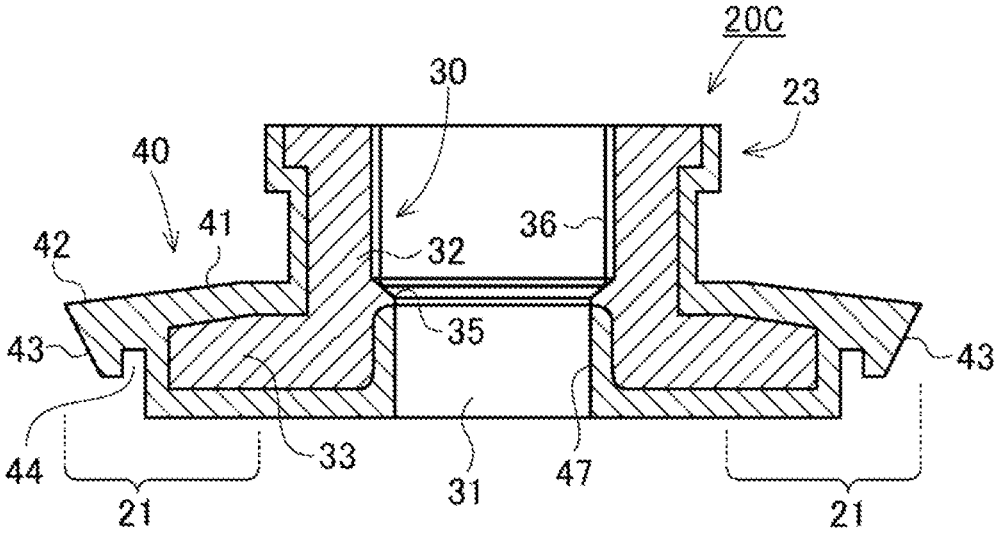
FIG. 7 is a cross-sectional view illustrating a structure of a stock used for a pressure vessel according to a fourth embodiment of the present invention.

FIG. 7 illustrates a stock 20C used in a pressure vessel according to the fourth embodiment of present the invention.

The stock 20C illustrated in FIG. 7 is not provided with the molded piece top section 49 illustrated in the above-described first to third embodiments. In this case, an O-ring is mounted to an outer circumferential surface of a leading end portion of a valve to be inserted into the gas entrance 31, and is made come into contact with the inner circumferential surface section 47 of the mold piece in a freely slidable manner. Other configurations are the same as those of the stock 20, and the same reference numerals designate the same parts.

[Fifth Embodiment]

Figure 8:
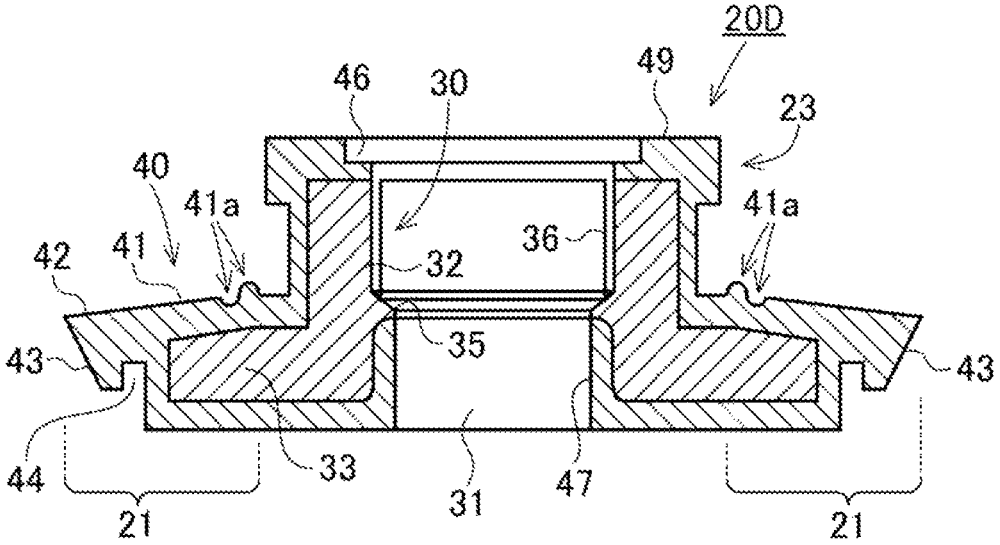
FIG. 8 is a cross-sectional view illustrating a structure of a stock used for a pressure vessel according to a fifth embodiment of the present invention.

FIG. 8 illustrates a stock 20D used in a pressure vessel according to the fifth embodiment of the present invention.

The stock 20D illustrated in FIG. 8 has unevenness 41*a* formed on the top surface section 41 of the molded piece 40. This makes it possible to further enhance the adhesive strength between the molded piece 40 and the liner body 11. Other configurations are the same as those of the stock 20, and the same reference numerals designate the same parts.

[Sixth Embodiment]

Figure 9:
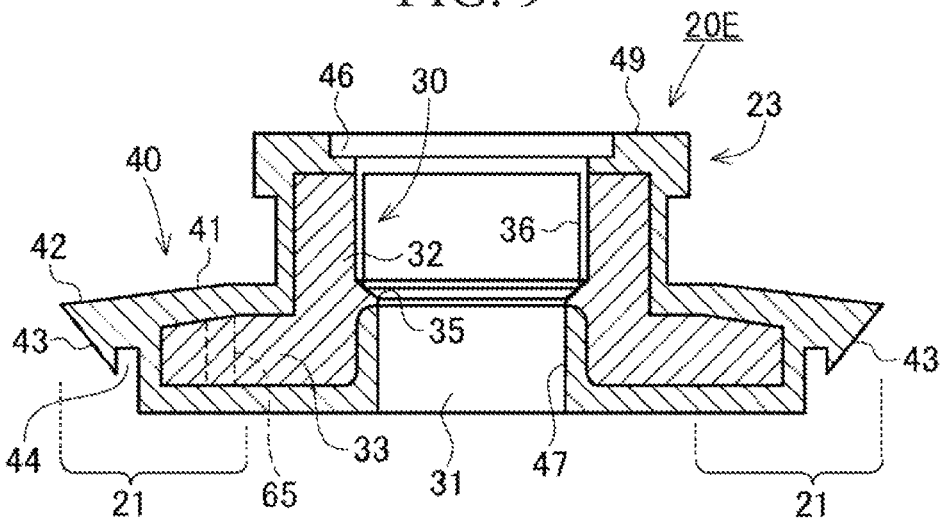
FIG. 9 is a cross-sectional view illustrating a structure of a stock used for a pressure vessel according to a sixth embodiment of the present invention.
Figure 10:
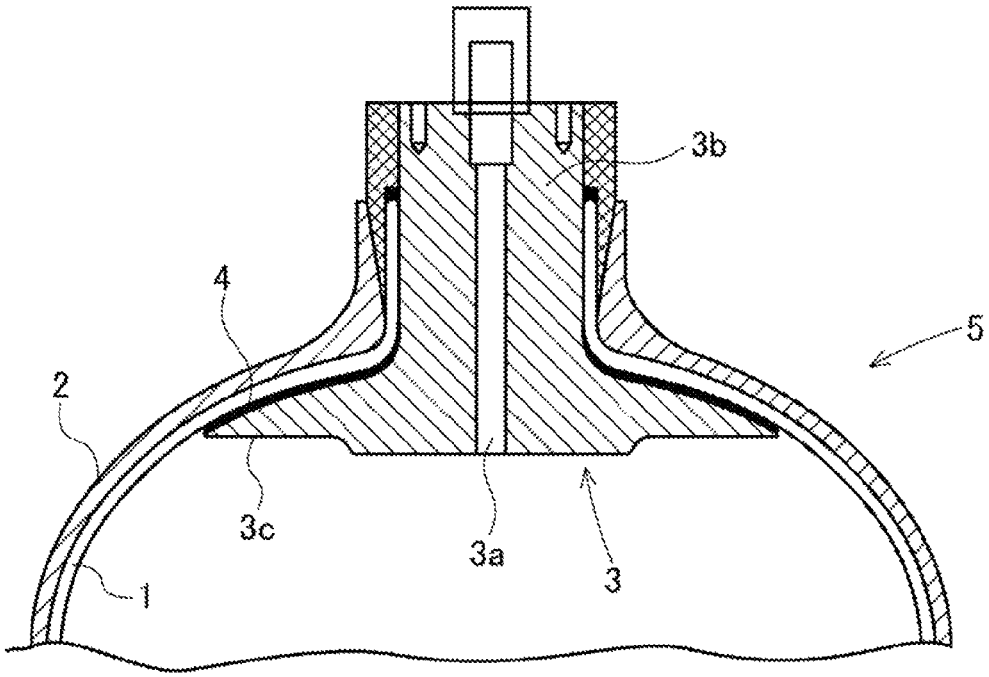
FIG. 10 is a cross-sectional view illustrating a structure near a stock of a conventional pressure vessel.
Figure 11:
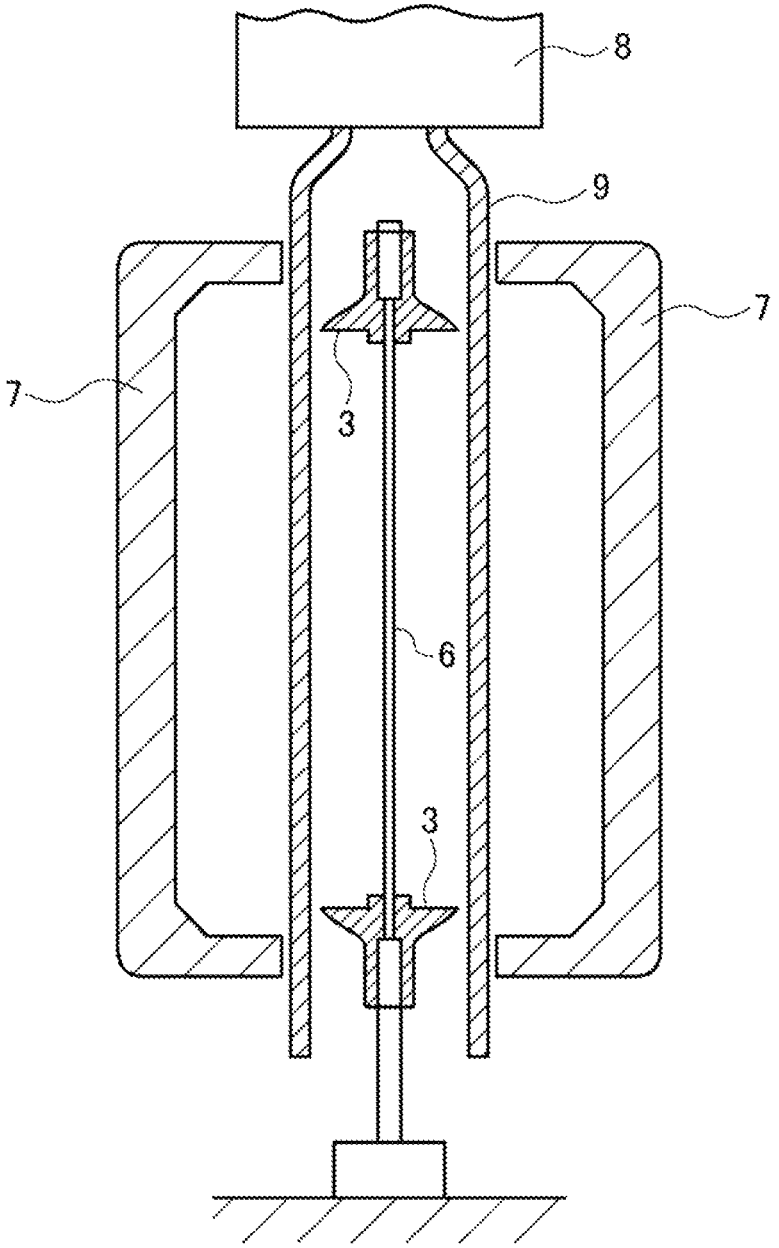
FIG. 11 is a cross-sectional view illustrating a method of manufacturing the conventional pressure vessel illustrated in FIG. 10.

FIG. 9 illustrates a stock 20E used in a pressure vessel according to the sixth embodiment of the invention.

The stock 20E illustrated in FIG. 9 has an outermost circumferential section (resin flange section 42) of the molded piece 40 having a triangular cross-sectional shape. That is, in each of the above-described caps 20 and 20A to 20D, the lower end of the outer circumferential end surface 43 and the groove 44 are slightly spaced from each other, but in the stock 20E of FIG. 9, the lower end of the outer circumferential end surface 43 reaches the beginning corner edge of the groove 44. Other configurations are the same as those of the stock 20, and the same reference numerals designate the same parts.

In the above-described first to sixth embodiments of the present invention, in each of the stocks 20 and 20A to 20E, the metal flange section 33 may be provided with a through hole 65 (indicated with broken lines in FIG. 9) through which the upper surface and the lower surface of the metal flange section communicate with each other. Furthermore, by filling the through hole 65 with the mold piece 40, the top surface section 41 and the molded piece on the lower surface side of the metal flange section 33 may be connected to each other with the molded piece 40 filling the through hole 65.

Although it is not illustrated, in the present invention, the outer circumferential surface of the cylindrical section 32 of the stock main body 30 need not be covered by the molded piece 40.

In order to enhance the adhesion between the stock main body 30 and the molded piece, the surface of the stock main body 30 may be roughened by sand-blasting, shot-blasting, cutting process or the like, and may be subjected to various surface treatments.

In addition, as a material of the liner body 11 that house high-pressure gases contained in the pressure vessel 10 and have gas barrier properties for preventing leakage, polyolefin resins such as high-density polyethylene-based resin, cross-linked polyethylene, polypropylene resin, and cyclic olefin-based resin, polyamide-based resins such as nylon 6, nylon 6, 6, nylon 11 and nylon 12, polyester-based resins such as poly(ethylene terephthalate) and poly(butylene terephthalate), and engineering plastics such as acrylonitrile-butadiene-styrene copolymer (ABS) resin, polyacetal resin, polycarbonate resin, poly(phenylene ether) resin, poly(phenylene sulfide) resin, polysulfone resin, or polyimide resin can be exemplified. However, the material of the liner body 11 is not limited to the materials described above.

The liner body 11 may be constituted by a single layer body, a multi-layer body, or a composite material of the above-described thermoplastic resin. For example, the liner body may be formed of a composite material in which gas barrier resin such as a engineering plastic, ethylene-(vinyl alcohol) copolymer (EVOH) or poly(vinyl alcohol) (PVA) resin, elastomer, a metal member or an inorganic filler is dispersed in the high-density polyethylene-based resin layer, and as a structure of the liner body 11, a laminate having a multi-layer structure containing at least a thermoplastic resin layer/an adhesive layer/a barrier layer may be used.

As the above-described engineering plastic, various polyamide (PA) resins such as nylon 6, nylon 6,6, nylon 11 and nylon 12, various polyester resins such as poly(ethylene terephthalate) (PET) or poly(butylene terephthalate) (PBT), acrylonitrile-butadiene-styrene copolymer (ABS) resin, acrylonitrile-styrene copolymer (AS) resin, polycarbonate (PC) resin, polyacetal (POM) resin, poly(phenylene ether) (PPE) resin, poly(phenylene sulfide) (PPS) resin, aromatic polyester resin (liquid crystal resin) and the like can be exemplified.

As the inorganic filler, talc, silica, calcium carbonate, mica or the like can be exemplified, but fine powder talc or fine powder mica having a plate-like crystal structure having an average particle size of 0.5 to 10 μm is preferred to others.

Furthermore, as the material and the structure of the synthetic resin liner having a laminated structure, a three-kind three-layer structure of a thermoplastic resin layer such as the above-described high-density polyethylene/an adhesive layer/a barrier layer, a three-kind five-layer structure of a thermoplastic resin layer/an adhesive layer/a barrier layer/an adhesive layer/a thermoplastic resin layer, a laminate having three or more layers, such as a four-kind six-layer structure of a thermoplastic resin layer/a recycled resin layer/an adhesive layer/a barrier layer/an adhesive layer/a thermoplastic resin layer and a two-kind two-layer of a thermoplastic resin layer/an adhesive layer or the like can be exemplified.

As the material suitably used for the barrier layer, polyamide resin, polyester resin, ethylene-(vinyl alcohol) copolymer, poly(vinyl alcohol) resin, polyacrylonitrile resin or the like can be exemplified.

As a winding method such as a filament winding method or a tape winding method for forming the FRP layer 12, any one of helical winding, hoop winding, label winding may be adopted, and a combination thereof may be used. Furthermore, as the winding method, specifically, for example, there is a method for winding while loading the resin to the reinforcing fiber (bundle) during the winding process or a method for winding the reinforcing fiber (bundle) impregnated with resin in advance (prepreg). Furthermore, the FRP layer may be formed by other methods, such as a prepreg method in which a continuous reinforcing material such as fabrics is formed after being impregnated with thermosetting resin.

As the reinforcing fiber for forming the FRP layer, carbon fiber, glass fiber, organic high-modulus fiber (for example, aramid fiber, ultra-high-strength polyester fiber), metal fiber, ceramic fiber or the like can be exemplified, and it is also possible to use one kind thereof or two or more kinds thereof in combination.

As a resin for forming the FRP layer, thermosetting or photo-curable resins, such as epoxy resin, unsaturated polyester resin, urea resin, phenolic resin, melamine resin, polyurethane resin, polyimide resin and vinyl ester resin, polyamide resin, polyester resins such as poly(ethylene terephthalate) and poly(butylene terephthalate), engineering plastic such as ABS resin, poly(ether ketone), and poly (phenylene sulfide) and thermoplastic resins such as polypropylene and poly-4-methyl-1-pentene resin can be exemplified.

As the metal constituting the stock main body 30, iron, aluminum, copper, nickel, titanium or alloys thereof (for example, brass) can be exemplified, but the metal is not limited thereto.

The each of the above embodiments is an example of the present invention, and the present invention may be in the form other than the above.

EXPLANATIONS OF LETTERS OR NUMERALS

10 Pressure vessel
11 Liner body
**11*t*** Bulged portion
12 FRP layer
20, 20A to 20E Stock
21 Flange section
30 Stock main body
31 Gas entrance
32 Cylindrical section
33 Metal flange section
35 Elongated convexity
36 Female screw
40 Molded piece
41 Top surface section
42 Resin flange section
43 Outer circumferential end surface
44 Groove
51 Blow-molding die
54 Circular die
55 Parison
60 Metal ring

The invention claimed is:

1. A pressure vessel comprising:

a liner body formed by blow-molding;

an FRP layer that covers an outer surface of the liner body; and a stock having a stock main body formed of metal, which has a cylindrical section that passes through the liner body and the FRP layer and an annular metal flange section that projects outward from one end of the cylindrical section in a radial direction of the cylindrical section, and a molded piece including a synthetic resin that covers at least an outer circumferential surface of the cylindrical section and the entire metal flange section of the stock main body, and an annular resin flange section projecting outward from a portion of the synthetic resin covering a leading end of the metal flange section in the radial direction, the molded piece adhering to the inner surface of the liner body, wherein the resin flange section has an upper surface, an outer circumferential end surface and a lower surface, the outer circumferential end surface is provided on an end portion of the resin flange section that faces outward in the radial direction, the liner body continuously covers the upper surface and a part of the outer circumferential end surface, and the liner body does not cover the lower surface.

2. The pressure vessel according to claim 1, wherein the intersecting angle θ between the outer circumferential end surface and the upper surface is an acute angle.

3. The pressure vessel according to claim 2, wherein the intersecting angle θ is 20° to 60°, and the height of the outer circumferential end surface is 1 to 30 mm.

4. The pressure vessel according to claim 1, wherein the molded piece continuously covers from the lower surface of the metal flange section to the inner circumferential surface of the cylindrical section.

5. The pressure vessel according to claim 1, wherein the metal flange section is provided with a through hole through which the upper surface and the lower surface of the metal flange section communicate with each other, and the molded piece fills the through hole.

6. The pressure vessel according to claim 1, wherein the molded piece is formed by injection molding.

7. The pressure vessel according to claim 1, wherein the liner body is arranged between the outer circumferential surface of the cylindrical section and the FRP layer.

8. The pressure vessel according to claim 1, wherein the liner body is composed of a thermoplastic resin.

* * * * *